US007578157B2

(12) United States Patent
Yamakawa et al.

(10) Patent No.: US 7,578,157 B2
(45) Date of Patent: Aug. 25, 2009

(54) PIERCING-ROLLING METHOD AND PIERCING-ROLLING APPARATUS FOR SEAMLESS TUBES

(75) Inventors: Tomio Yamakawa, Kawanishi (JP); Kazuhiro Shimoda, Nishinomiya (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/155,658

(22) Filed: Jun. 6, 2008

(65) Prior Publication Data

US 2008/0289388 A1 Nov. 27, 2008

Related U.S. Application Data

(63) Continuation of application No. PCT/JP2007/063499, filed on Jul. 5, 2007.

(30) Foreign Application Priority Data

May 21, 2007 (JP) ..... 2007-134335

(51) Int. Cl.
*B21B 19/04* (2006.01)

(52) U.S. Cl. ..... 72/97; 72/366.2

(58) Field of Classification Search ..... 72/95, 72/96, 97, 100, 101, 102, 208, 209, 366.2
See application file for complete search history.

(56) References Cited

U.S. PATENT DOCUMENTS

| | | | | | |
|---|---|---|---|---|---|
| 4,559,799 | A | * | 12/1985 | Funke et al. | 72/224 |
| 5,636,542 | A | * | 6/1997 | Yamakawa et al. | 72/97 |
| 5,713,234 | A | * | 2/1998 | Yamakawa et al. | 72/97 |
| 2007/0214855 | A1 | * | 9/2007 | Hiraishi | 72/69 |

FOREIGN PATENT DOCUMENTS

| | | | |
|---|---|---|---|
| JP | 61-144204 | * | 1/1986 |
| JP | 63-90306 | | 4/1988 |
| JP | 3-27806 | * | 2/1991 |
| JP | 5-124612 | | 5/1993 |
| JP | 5-138212 | * | 6/1993 |
| JP | 5-161903 | * | 6/1993 |
| JP | 5-169110 | * | 7/1993 |
| JP | 5-177220 | * | 7/1993 |
| JP | 6-218420 | | 8/1994 |
| JP | 3021664 | | 1/2000 |
| JP | 2001-179324 | | 7/2001 |

* cited by examiner

*Primary Examiner*—Edward Tolan
(74) *Attorney, Agent, or Firm*—Clark & Brody

(57) ABSTRACT

To provide a method and apparatus for seamless tubes in which the occurrence of material peeling can be prevented even when the skew angle δ and tube expansion ratio are increased.

A piercing-rolling method for seamless tubes using a piercer, which is provided with a pair of cone-shaped main rolls and a pair of disk rolls, each pair being arranged in an opposing manner with a pass line therebetween as a center axis, and a plug whose center axis coincides with the pass line, wherein a billet to be pierced and rolled is advanced while being spirally rotated by a drive rotation of the main rolls; the method of which is characterized in each of the disk rolls being arranged in an inclined state at a fixed skew angle δ to the pass line.

6 Claims, 9 Drawing Sheets

PIERCING-ROLLING METHOD AND PIERCING-ROLLING APPARATUS FOR SEAMLESS TUBES

This application is a continuation of International Patent Application No. PCT/JP2007/063499, filed Jul. 5, 2007.

FIELD OF THE INVENTION

The present invention relates to a piercing-rolling method and apparatus using a piercer adopted for the Mannesmann tube manufacturing process that is a typical process for the manufacture of seamless tubes.

BACKGROUND OF THE INVENTION

Generally, in manufacturing tubes according to the Mannesmann tube making process, a billet (round steel billet) is first pierced by means of a piercer to form a hollow shell, which is then elongated, and rolled in a constant diameter and further subjected to a processing step to produce a seamless tube. The piercer is an inclined rolling mill in which main rolls whose axes are inclined relative to the pass line of the billet to be rolled are used in combination with a plug.

The piercer for developing the Mannesmann tube manufacturing process generally comprises a pair of main rolls that are arranged in an opposing manner with a pass line, a plug for the inner surface regulating tool that is arranged along that pass line, and guide shoes or disk rolls for the shell guide members that are arranged in an opposing manner with a pass line.

FIG. 1 shows an exemplary arrangement of the main rolls in an inclined piercing-rolling mill. FIG. 2 is a cross-sectional view along the line V-V in FIG. 1. FIG. 3 is a view of the inclined piercing-rolling mill as seen from the outlet side.

As shown in FIG. 1, the cone-shaped main rolls 1R, 1L have an outlet side surface angle $\alpha$ and are arranged in axial symmetry with their axes each toe with the pass center m at the toe angle $\gamma$.

Further, as shown in FIG. 2, the main roll 1L is arranged to form a feed angle $\beta$. The other roll 1R (not shown) is also arranged at a feed angle $\beta$, and each of the rolls is in a skew position. The toe angle $\gamma$ and the feed angle $\beta$ for these main rolls 1R, 1L are defined relative to the center of the gorge between the main rolls 1R, 1L shown in FIG. 3. The plug 7 is arranged between the main rolls 1, 1 and the tip thereof is positioned in the vicinity of the center of the gorge formed by the main rolls 1, 1.

The main rolls 1R, 1L are respectively connected to the driving force sources 3, 3 via driving shafts 2, 2. By this means, the main rolls 1, 1 are rotated around their respective axes in the direction shown in FIG. 3, for instance. As shown in FIG. 1, the main rolls 1R, 1L are in mutually twisted positions owing to the setting of the feed angle $\beta$. When the main rolls 1R, 1L are rotated in the direction indicated by the arrows in the figures, the billet 6 is inserted between the main rolls and pierced while it is rotated in the clockwise direction, as seen from the outlet side, around the pass center m. In this way, the billet is pierced and rolled by the main rolls 1R, 1L and the plug 7 to give a hollow shell 9.

During the piercing in that manner, the billet swings upward and downward due to the pressing forces exerted by the main rolls 1R, 1L. In order to suppress this swinging, a pair of disk plates are arranged above and below the main rolls 1R, 1L.

FIG. 4 shows an exemplary arrangement of the main rolls and disk rolls in an inclined piercing-rolling mill. The disk rolls 10 are arranged symmetrically above and below the main rolls 1R, 1L in the vicinity thereof in a manner sandwiching the billet 6 and are rotated around the respective disk roll shafts 12. These disk rolls 10 are rotated along with the advancement of the billet and suppress the swinging of the billet 6 so that the rolling may proceed smoothly.

However, the main rolls 1R, 1L each has an outlet side surface angle $\alpha$, as shown in FIG. 1, and further has a toe angle $\gamma$ to the pass center m, so that there are gaps G, G between the disk rolls 10 and the main rolls 1, as shown in FIG. 4. When the billet 6 rotates and advances along the pass center m, the hollow shell in contact with the surfaces of the disk rolls 10 may be extruded through the gaps G, G.

A movement of the hollow shell formed on the roll outlet side from the gorge between the main rolls is shown in FIG. 5. The bulging of the outside diameter of the billet on the side where it is held by the main roll 1R becomes larger than the bulging of the outside diameter of the billet on the side where it leaves the other main roll 1L. Referring to FIG. 6 in which the disk rolls are also shown, the bulging of the section (section B in the figure), where the billet is held by the main roll 1R, is greater than the bulging in the section (section A in the figure) where the billet leaves the main roll 1L but the bulges are reduced by the pair of the disk rolls 10U, 10D arranged above and below the billet.

In an ordinary piercing-rolling process where the tube expansion ratio, a ratio of the outside diameter of the billet after piercing to the outside diameter of the billet before piercing, [billet outside diameter after piercing]/[billet outside diameter before piercing], is 1.0 to 1.05, therefore the bulging of the billet outside diameter in the section B shown in FIG. 6 causes no problem. However, when piercing-rolling process is carried out at a higher tube expansion ratio, the circumferential length of the hollow shell formed on the main roll outlet side becomes larger, so that the bulging in the section B shown in FIG. 6 increases and the holding angle ø by the main roll 1L also increases. As a result, at the time of billet leakage when the driving force in the rolling direction becomes smaller in an unsteady piercing and rolling state, the billet no longer rotates and buttock clogging occurs, so that the hollow shell end shows a large ellipsoidal shape and causes a problem of formation of shoe mark defects on the outside surface of the hollow shell.

Patent Document 1 below proposes means for solving such problems.

FIG. 7 is a schematic plan view illustrating the arrangement of the main rolls and disk rolls. The main roll 1R is arranged on the right side in the direction of outlet of the billet 6 and the main roll 1L on the left side, with their axes in mutually twisted positions. The main roll 1R is inclined upward on the inlet side and downward on the outlet side, and the main roll 1L is inclined on the opposite manner.

The disk roll 10U is arranged above the billet 6, and the disk roll 10D is arranged symmetrically below the billet 6. The disk roll 10U is arranged so that the outlet side thereof, with the disk roll center as an axis, may be closer to the main roll 1R and parallel to the outlet side surface of the main roll 1R. The disk roll 10D is arranged so that the outlet side thereof may be closer to the main roll 1L and parallel to the outlet side of the main roll 1L. The disk roll 10U forms a disk roll skew angle $\delta$ to the pass center m, and the disk roll 10D likewise forms a disk roll skew angle $\delta$.

When the main rolls 1R, 1L are rotated in the direction indicated by the arrows in the figure, the billet 6 is rolled while rotating in the clockwise direction seen from the outlet side. On that occasion, the billet is guided by the disk rolls 10U, 10D so that it may be taken up by the main rolls 1R, 1L at a smaller holding angle ø and thus the billet is prevented from being caught up, according to the description.

Thus, it is proposed that the technology preventing the billet during rolling from protruding by providing an inclination mechanism for varying the skew angle in order to dispose the disk rolls substantially parallel to the outlet surface angle of the main rolls and a moving mechanism for setting the gaps between the main rolls and the disk rolls substantially at zero.

Further, Patent Document 2 below proposes that a pair of cone-shaped main rolls having an inlet surface angle and an outlet surface angle and a pair of disk rolls having a skew angle varying mechanism be arranged alternately around the pass line and a seamless metal tube manufactured by piercing and rolling be carried out at a skew angle such that the skew angle of the disk rolls and the inlet surface angle and outlet surface angle satisfy a specific relation. The buttock clogging or outer surface defects can be prevented thereby even in the case of piercing and rolling at an increased tube expansion ratio of 1.15 or higher.

[Patent Document 1] Japanese Patent Unexamined Publication No. S63-90306

[Patent Document 2] Japanese Patent Unexamined Publication No. H05-124612

DISCLOSURE OF THE INVENTION

Problem to be Solved by the Invention

However, the technologies disclosed in Patent Documents 1 and 2 above, have the following problem:

When piercing and rolling are carried out under an increase in the tube expansion ratio, material peeling may occur and the pierced and rolled hollow shell may show deviation in wall thickness.

In view of the above-discussed state of the art, it is an objective of the present invention to provide a manufacturing method and apparatus for a seamless tube by piercing and rolling, by which the occurrence of material peeling and of deviation in the pierced and rolled hollow shell thickness can be prevented.

Means for Solving the Problem

The present inventors made investigations concerning the cause of the material peeling during the piercing and rolling at increased tube expansion ratios and a method of preventing the same and, as a result, obtained the following findings (a) to (g).

(a) All the prior inclined disk rolls that are arranged around the pass line have a low rigidity in the supporting devices and, therefore, even when the main roll 1L and the disk roll 10U are arranged with a narrow gap G between them, as shown in FIG. 8 by the solid lines, the force of piercing and rolling in the direction of the rotation of the material is exerted on the disk roll. It was found that the position of the disk roll shifts to the position shown by the broken lines and the gap G widens.

(b) It was found that when the gap G between the main roll and disk roll widens, part of the billet enters this widened gap G and causes material peeling.

(c) It was also found that when the rigidity of the disk roll-supporting device is increased so that even when the force of the direction of the rotation of the billet is exerted on the disk roll, the disk roll may not shift from the set-up position. Therefore the disk roll may be fixed at the position shown in FIG. 8 by the solid lines, and it becomes possible to carry out piercing and rolling while maintaining the gap G between the main roll 1R and the disk roll 10U at a constant level and this prevents the material peeling from occurring. It was also found that suppressing the shifting of the disk roll from the set-up position to a certain extent, even when the position of the disk roll cannot be fixed completely, could prevent the material peeling.

(d) The reason why all the prior inclined disk rolls that are arranged around the pass line have a low rigidity in the supporting devices was found to be due to that a rotation mechanism R is provided for varying the disk roll skew angle δ, as shown in FIG. 9. It was also found that when such a rotation mechanism R is not used, the rigidity of the disk roll-supporting device could be increased.

(e) It was found that fixing the disk roll skew angle δ is effective in order to increase the rigidity of the disk roll device, as shown in FIG. 10. Here, the disk roll 10U is rotated in connection with a universal joint 12U, and the skew angle δ is fixed in an inclined position by means of roll chocks 21R, 21L supported by chock supports 22R, 22L. The skew angle δ may be set and fixed at a prescribed skew angle δ.

Regarding the shape of the disk roll, as shown in FIG. 10, a disk shape having a curved groove bottom around the periphery is preferred. The disk shape is preferably so that the central part is relatively thick and the peripheral part around the central part is relatively thin.

(f) The occurrence of material peeling can be prevented by fixing the skew angle δ which is the angle of inclined arrangement of the disk roll 10 relative to the pass line, as mentioned hereinabove. However, when the average thickness value Dw1 of the disk roll 10 is narrow relative to the outside diameter of the billet 6, there is a possibility that the disk roll 10 could be bent in the direction of the rotation of the billet 6; in this case, the gap G between the main roll 1 and the disk roll 10 may possibly widen.

Therefore, in order to prevent the occurrence of peeling of the rolled billet more reliably, the ratio of the average thickness value Dw1 of the disk roll to the billet diameter d is preferably increased to a certain extent. Based on this finding and various further investigations and experiments, the present inventors found that the occurrence of peeling of the rolled billet can be prevented more reliably when the following inequality (1) is satisfied:

$$Dw1/d>0.8 \qquad \text{inequality (1)}$$

wherein $Dw_1$ and d are, respectively, an average thickness of the disk roll and an outside diameter of the billet to be pierced and rolled, while the average thickness of the disk roll is an average thickness of the disk-shaped body excluding the peripheral curved groove part.

(g) In further investigations in search of a method of preventing the occurrence of peeling while paying attention to the disk roll, it was found that the wall thickness deviation problem, namely the formation of the spiral thick part on the surface of the pieced and rolled billet, can be solved simultaneously.

As a result of examination into the cause of the occurrence of the wall thickness deviation, it was found that the following causes the wall thickness deviation:

The billet bottom area, during piercing and rolling, forms a hollow shell long in circumferential length. The hollow shell swings and rotates and, further, the disk roll comes into contact with the hollow shell during formation by reducing the outside diameter of the hollow shell, with the result that the hollow shell wall thickness is locally increased.

And, the following finding was also obtained:

When the distance Ds between the peripheral groove bottoms corresponding to the smallest diameter of the disk roll, the width $Dw_2$ of the curved surface part on the peripheral surface of the disk roll, and the outside diameter d of the billet to be pierced and rolled, are selected in order to satisfy the following inequalities (2) and (3), the occurrence of such wall thickness deviation can be prevented.

$$9 \leqq Ds/d \leqq 16 \quad \text{inequality (2)}$$

$$Dw2/d > 0.8 \quad \text{inequality (3)}$$

wherein Ds is a distance between the peripheral groove bottoms corresponding to the smallest diameter of disk roll, $Dw_2$ is a width of the curved surface part on the peripheral surface of disk roll, and d is an outside diameter of the billet to be pierced and rolled.

What is prescribed by the lower limit in the inequality (2) above and what is prescribed by the inequality (3) above are necessary factors, in order to prevent a swinging rotation of the hollow shell on the occasion of formation of the hollow shell long in circumferential length by piercing and rolling of the billet bottom part and maintaining the amount reducing the outside diameter of the hollow shell and locally increasing the hollow shell wall thickness within a range to be corrected by means of the plug and main rolls. And, what is prescribed by the upper limit in the inequality (2) above is a necessary factor in order to maintain the amount reducing the hollow shell outside diameter and locally increasing the hollow shell wall thickness within a range to be corrected by means of the plug and main rolls when the disk rolls temporarily restrict the hollow shell during the formation in the direction of the progress of the billet.

The present invention has been completed based on the following findings. The gist is a piercing-rolling method for seamless tubes as specified below under (1) to (3) and a piercing-rolling apparatus for seamless tubes as specified below under (4) to (6).

(1) A piercing and rolling method for seamless tubes using a piercing and rolling apparatus which is provided with a pair of cone-shaped main rolls and a pair of disk rolls, each pair being arranged in an opposing manner with a pass line therebetween as a center axis, and a plug whose center axis coincides with the pass line, wherein a billet to be pierced and rolled is advanced while being spirally rotated by a drive rotation of the main rolls; the method of which is characterized in each of the disk rolls being arranged in an inclined state at a fixed skew angle δ to the pass line.

(2) The piercing and rolling method for seamless tubes according to (1) above, characterized in that the average thickness Dw1 of the disk roll and an outside diameter d of the billet to be pierced and rolled satisfy the following inequality (1):

$$Dw1/d > 0.8 \quad \text{inequality (1)}$$

wherein Dw1 and d are, respectively, the average thickness of the disk roll and an outside diameter of the billet to be pierced and rolled, while the average thickness of the disk roll is the average thickness of the disk-shaped body excluding the peripheral curved groove part.

(3) The piercing and rolling method for seamless tubes according to (1) or (2) above, characterized in that a distance Ds between the peripheral groove bottoms corresponding to the smallest diameter of the disk roll, a width Dw2 of the curved surface part on the peripheral surface of disk roll, and an outside diameter d of the billet to be pierced and rolled, are selected so as to satisfy the following inequalities (2) and (3):

$$9 \leqq Ds/d \leqq 16 \quad \text{inequality (2)}$$

$$Dw2/d > 0.8 \quad \text{inequality (3)}$$

wherein Ds is a distance between the peripheral groove bottoms corresponding to the smallest diameter of disk roll, Dw2 is a width of the curved surface part on the peripheral surface of the disk roll, and d is an outside diameter of the billet to be pierced and rolled.

(4) A piercing and rolling apparatus for seamless tubes which is provided with a pair of cone-shaped main rolls and a pair of disk rolls, each pair being arranged in an opposing manner with a pass line therebetween as a center axis, and a plug whose center axis coincides with the pass line, wherein a billet to be pierced and rolled is advanced while being spirally rotated by a drive rotation of the main rolls; the apparatus of which is characterized in each of the disk rolls being arranged in an inclined state at a fixed skew angle δ to the pass line.

(5) The piercing and rolling apparatus for seamless tubes according to (4) above, characterized in that the average thickness Dw1 of disk roll and an outside diameter d of the billet to be pierced and rolled satisfy the following inequality (1):

$$Dw1/d > 0.8 \quad \text{inequality (1)}$$

wherein Dw1 and d are, respectively, an average thickness of the disk roll and an outside diameter of the billet to be pierced and rolled, while the average thickness of the disk roll is the average thickness of the disk-shaped body excluding the peripheral curved groove part.

(6) The piercing and rolling apparatus for seamless tubes according to (4) or (5) above, characterized in that a distance Ds between the peripheral groove bottoms corresponding to the smallest diameter of disk roll, a width Dw2 of the curved surface part on the peripheral surface of the disk roll, and an outside diameter d of the billet to be pierced and rolled, are selected so as to satisfy the following inequalities (2) and (3):

$$9 \leqq Ds/d \leqq 16 \quad \text{inequality (2)}$$

$$Dw2/d > 0.8 \quad \text{inequality (3)}$$

wherein Ds is a distance between the peripheral groove bottoms corresponding to the smallest diameter of disk roll, Dw2 is a width of the curved surface part on the peripheral surface of the disk roll, and d is an outside diameter of the billet to be pierced and rolled.

Result of the Invention

According to the invention, the occurrence of material peeling can be prevented and at the same time wall thickness deviation in the pierced and rolled hollow shell can be prevented in manufacturing seamless tubes by piercing and rolling even when the tube expansion ratio is increased.

BEST MODE FOR CARRYING OUT THE INVENTION

Referring to the drawings, the present invention is illustrated more specifically in the following.

EXAMPLE 1

FIG. 11 is a schematic elevation of a piercing-rolling apparatus according to the invention with each disk roll given a skew angle δ, as seen from the outlet side thereof.

First, cone-shaped main rolls 1R, 1L are arranged in axial symmetry each at a feed angle β with their axes each further forming a toe angle γ relative to the pass center m, similar in the conventional methods and apparatus described hereinabove. The cone-shaped main rolls 1R, 1L have an outlet surface angle α. The disk rolls 10U, 10D adopted each has different right and left edge diameters and they are arranged so as to hold the billet 6 during piercing from above and from below. The disk roll 10U is arranged above the billet 6 with the larger diameter edge facing the main roll 1R side, and the disk roll 10D below the billet 6 with the larger diameter edge facing the main roll 1L side, namely with each larger diameter edge being located upstream of the direction of the rotation of the billet 6 and each smaller diameter edge downstream of the direction of the rotation. When the arrangement of the disk rolls is selected from the edge diameter viewpoint, as mentioned above, the effect of preventing the material from extruding out at sites both upstream and downstream in the direction of rotation is produced. The plane A is a plane including the pass center m for the tube material and the gorge center between the inclined rolls before setting the feed angle β.

The disk rolls 10U, 10D are given a skew so that the outlet side thereof may be along the main roll 1R on the leaving material side while the disk roll axes are maintained horizontally, more specifically parallel to the plane A, with their centers as axes. This angle δ is a skew angle of disk roll. As a result, the rotational axes of the disk rolls 10U, 10D are not in a state crossing the pass center m at a right angle.

The disk roll 10U is rotated in connection with a universal joint 12, as shown in FIG. 10, and the skew angle δ is fixed in an inclined state by means of roll chocks 21R, 21L supported by the chock supporting members 22R, 22L.

When the main rolls are rotated in the direction indicated by the arrows in FIG. 11, the billet 6 to be pierced is rolled while rotating in the clockwise direction with O as the center as seen from the outlet side. And, the billet 6 is pierced by means of the plug 7 (cf. FIG. 1) to form a hollow shell 9 (cf. FIG. 1) while being pressed from both sides in the gorge between the main rolls 1R, 1L.

An examination was made as to the limit to the occurrence of peeling by actually carrying out the piercing and rolling using a piercing-rolling apparatus according to the invention, in which the disk rolls were arranged in an inclined state with the skew angle δ fixed. The results of this examination are now described. The operation conditions were as shown below and the results were as shown in Table 1. Regarding the skew angle δ, each skew angle δ corresponding to each tube expansion ratio was set and fixed each time prior to carrying out piercing and rolling. The results obtained also shown in Table 1, for comparison by actually carrying out piercing and rolling using a conventional apparatus, in which the skew angle δ was variable (0° to 9°) by means of the rotation mechanism.

[Operation Conditions]

Billet: continuously cast material (0.2% C steel), 65 mm in diameter

Tube expansion ratio: 1.0 to 1.4

Ratio (t/d) of hollow shell wall thickness t to the outside diameter d: 2.5 to 6.0%

Roll gorge diameter: 410 mm

Roll feed angle β: 10.0°

Roll toe angle γ: 15.0°

Roll inlet side surface angle: 3.0°

Roll outlet side surface angle α: 4.0°

Disk roll diameter: 1150 mm

[Table 1]

TABLE 1

| | Tube expansion ratio | | | | | | | | | |
|---|---|---|---|---|---|---|---|---|---|---|
| | 1.0 | | 1.1 | | 1.2 | | 1.3 | | 1.4 | |
| Shell ratio t/d | Variable | Fixed | Variable | Fixed | Variable | Fixed | Variable | Fixed | Variable | Fixed |
| 6.0% | ○ | ○ | ○ | ○ | ○ | ○ | ○ | ○ | ○ | ○ |
| 5.5% | x | ○ | ○ | ○ | ○ | ○ | ○ | ○ | ○ | ○ |
| 5.0% | x | x | ○ | ○ | ○ | ○ | ○ | ○ | ○ | ○ |
| 4.5% | — | — | x | ○ | ○ | ○ | ○ | ○ | ○ | ○ |
| 4.0% | — | — | x | x | x | ○ | ○ | ○ | ○ | ○ |
| 3.5% | — | — | — | — | x | x | x | ○ | ○ | ○ |
| 3.0% | — | — | — | — | — | — | x | x | x | ○ |
| 2.5% | — | — | — | — | — | — | — | — | x | x |

○: No peeling occurred.
x: Peeling occurred.
—: Piercing and rolling were not carried out.

Table 1 shows the results obtained by carrying out the piercing and rolling of two billets under their respective conditions; the mark ○ indicates that no peeling occurred in the two runs, and the mark x indicates that peeling occurred at least in one of the two runs. The mark - indicates that the piercing and rolling were not carried out.

According to the invention, the disk rolls arranged in an inclined state with the skew angle δ fixed resulted in less peeling occurring than in the disk rolls with the skew angle δ variable by means of a comparative rotation mechanism. The invention succeeds, without peeling, in producing the hollow shells with a smaller shell ratio t/d than the comparative at any tube expansion ratio, wherein t is a wall thickness and d is an outside diameter of the shell. Thus, according to the invention, the results indicate that the piercing-rolling method and apparatus can produce thinner wall seamless tubes without peeling occurring.

The results in this example were obtained using a model piercing-rolling mill under the operation conditions given above. Actual mills generally require a roll toe angle γ of 10 to 30°, a billet diameter of 150 to 380 mm, a roll diameter of 900 to 1500 mm, and a disk roll diameter of 1500 to 3500 mm.

And, appropriate respective dimensions are selected from the viewpoint of stability in piercing and rolling and a reduction of the load shearing stain on the billets.

EXAMPLE 2

Among some shell ratios t/d of every tube expansion ratio that are exhibited in Table 1 in which successfully hollow shells without peeling were produced, further experiments were executed by the model piercing-rolling mill whose disk rolls were arranged in an inclined state with the skew angle δ fixed and whose set values were the same as given above, in order to examine the correlation between the parameter $Dw_1/d$ and the occurrence of peeling. Here, $Dw_1$ and d are, respectively, an average thickness of disk roll and an outside diameter of the billet to be pierced and rolled, while the average thickness of disk roll is an average thickness of disk-shaped body excluding the peripheral curved groove part. The results are shown in Table 2.

[Table 2]

TABLE 2

| Tube expansion ratio | Shell ratio t/d (%) | $Dw_1/d$ 0.7 | 0.8 | 0.85 | 0.9 | 1.0 | 1.1 |
|---|---|---|---|---|---|---|---|
| 1.0 | 6.0 | ○ | ○ | ○○ | ○○ | ○○ | ○○ |
| | 5.5 | ○ | ○ | ○○ | ○○ | ○○ | ○○ |
| 1.1 | 6.0 | ○ | ○ | ○○ | ○○ | ○○ | ○○ |
| | 4.5 | ○ | ○ | ○○ | ○○ | ○○ | ○○ |
| 1.2 | 6.0 | ○ | ○ | ○○ | ○○ | ○○ | ○○ |
| | 4.0 | ○ | ○ | ○○ | ○○ | ○○ | ○○ |
| 1.3 | 6.0 | ○ | ○ | ○○ | ○○ | ○○ | ○○ |
| | 3.5 | ○ | ○ | ○○ | ○○ | ○○ | ○○ |
| 1.4 | 6.0 | ○ | ○ | ○○ | ○○ | ○○ | ○○ |
| | 3.0 | ○ | ○ | ○○ | ○○ | ○○ | ○○ |

○: At least one of 10 billets pierced showed peeling.
○○: None of 10 billets pierced showed peeling.

In Table 2, the mark '○' indicates that at least one of 10 billets pierced showed peeling, and the mark '○○' indicates that none of 10 billets pierced showed peeling. As a result, it was revealed that in the case of the disk rolls being arranged in an inclined state with the skew angle δ fixed, the frequency of peeling occurring became very low when the ratio $Dw_1/d$ was in excess of 0.8. This indicated that excess $Dw_1/d$ results in the making a thin wall of seamless tubes by piercing and rolling because of the markedly suppression of peeling.

EXAMPLE 3

Further, regarding the values of $Dw_1/d$ of 0.85 and 1.0 among the condition under which the experimental results were evaluated as '○○' in the peeling examination shown in Table 2, namely the experimental results did not show any peeling occurred of 10 billets pierced, further experiments were made in order to examine the correlation between the parameter Ds/d and the occurrence of wall thickness deviation, and also the correlation between the parameter $Dw_2/d$ and the occurrence of wall thickness deviation. Here, Ds is a distance between the peripheral groove bottoms corresponding to the smallest diameter of disk roll, $Dw_2$ is a width of the curved surface part on the peripheral surface of disk roll, and d is an outside diameter of the billet to be pierced and rolled. The effects to prevent the wall thickness deviation are shown in Table 3 in terms of A to C.

[Table 3]

TABLE 3

| Ds/d | $Dw_2/d$ 0.80 | 0.82 | 0.84 | 0.87 | 0.90 |
|---|---|---|---|---|---|
| 17 | C | C | B | B | A |
| 16 | B | A | A | A | A |
| 14 | B | A | A | A | A |
| 12 | C | A | A | A | A |
| 9 | C | A | A | A | A |
| 8 | C | C | C | C | B |

The wall thickness deviations are evaluated to the following grades according to the average wall thickness deviation (%) within the final 300 mm range of the hollow shell:

Grade A: Not higher than 5%.

Grade B: Higher than 5% but not higher than 7%.

Grade C: Higher than 7%.

Table 3 shows evaluations of wall thickness deviations, which are defined by the following grades according to the average wall thickness deviation (%) within the final 300 mm range of the hollow shell:

Grade A: Not higher than 5%.

Grade B: Higher than 5% but not higher than 7%.

Grade C: Higher than 7%.

Herein, the average wall thickness deviation (%) within the final 300 mm range of the hollow shell was obtained in the following manner:

For each of a total of 30 cross sections at 10 mm intervals in the lengthwise direction of the final 300 mm part of each hollow shell, wall thicknesses were measured at 8 points in the circumferential direction and the wall thickness deviation (%) was calculated according to the formula given below and the average of the thus-obtained wall thickness deviation (%) for the 30 sections was calculated.

Wall thickness deviation percentage=(maximum wall thickness among 8 points−minimum wall thickness among 8 points)/(average wall thickness of 8 points)×100%

As a result, it was revealed that when the disk rolls are arranged in an inclined state with the skew angle δ fixed and at the same time Ds/d=9 to 16 and $Dw_2/d$ is in excess of 0.8, the wall thickness deviation is very small. Thus, the results show that when $Dw_1/d$ is in excess of 0.8, Ds/d=9 to 16 and $Dw_2/d$ is in excess of 0.8, thin wall seamless tubes can be manufactured by piercing and rolling while satisfactorily preventing the occurrence of peeling and the occurrence of wall thickness deviation.

INDUSTRIAL APPLICABILITY

A method and apparatus are provided for piercing and rolling according to which the occurrence of material peeling can be prevented and the wall thickness deviation in the pierced and rolled hollow shell can be prevented during the manufacturing of seamless tubes by piercing and rolling even when the tube expansion ratio is increased.

EXPLANATION OF REFERRED SYMBOLS

Figure 1:
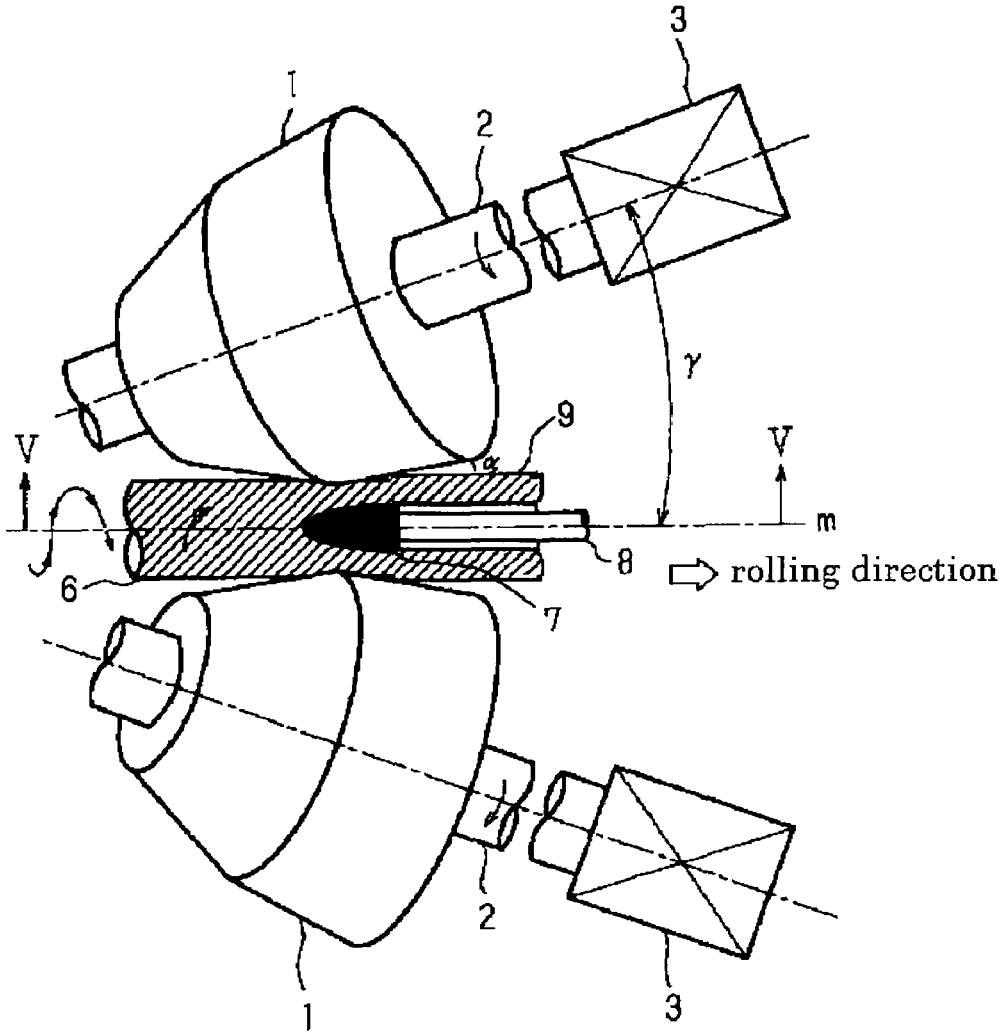
[FIG. 1] This shows an exemplary arrangement of main rolls in a piercing-rolling mill.
Figure 2:
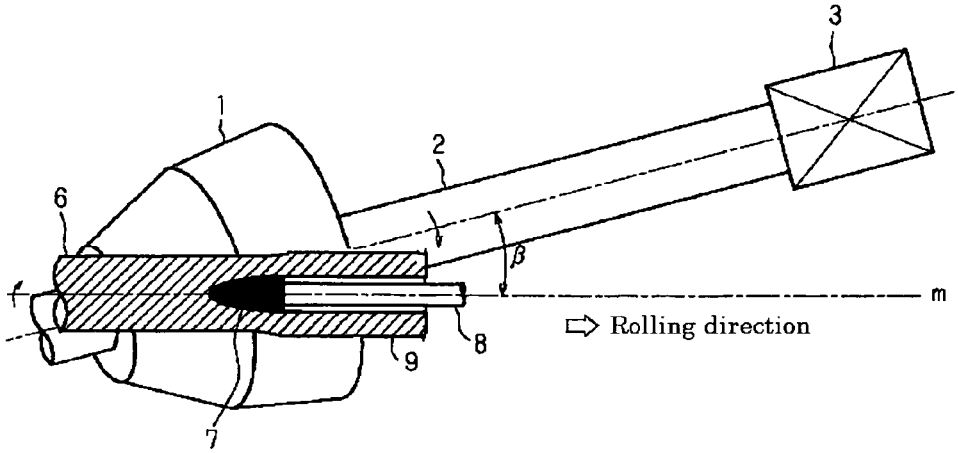
[FIG. 2] This shows a cross section along the line V-V in FIG. 1.
Figure 3:
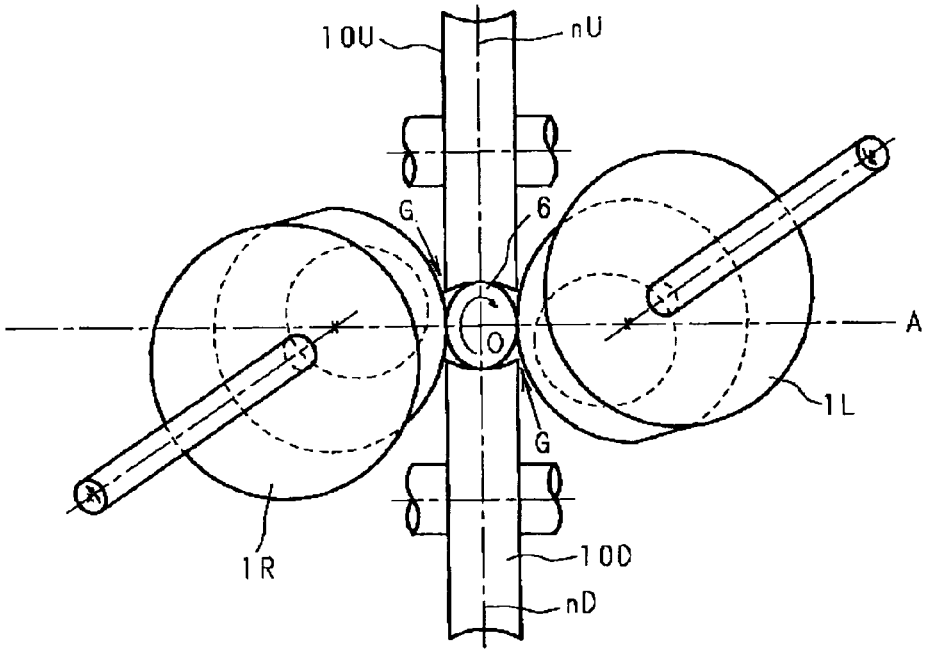
[FIG. 3] This shows a view of the piercing-rolling mill shown in FIG. 1 as seen from the outlet side.
Figure 4:
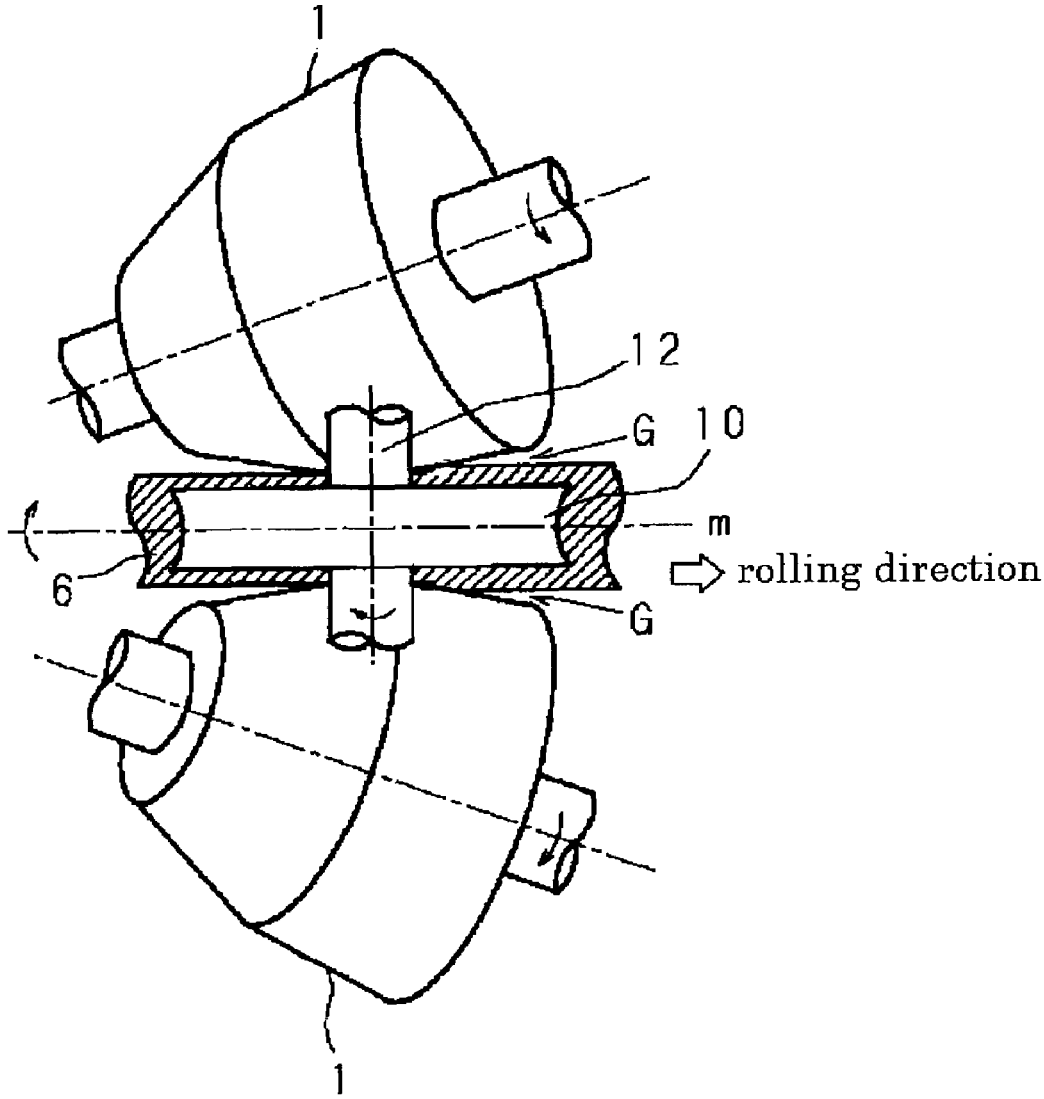
[FIG. 4] This shows an exemplary arrangement of main rolls and disk rolls in a piercing-rolling mill.
Figure 5:
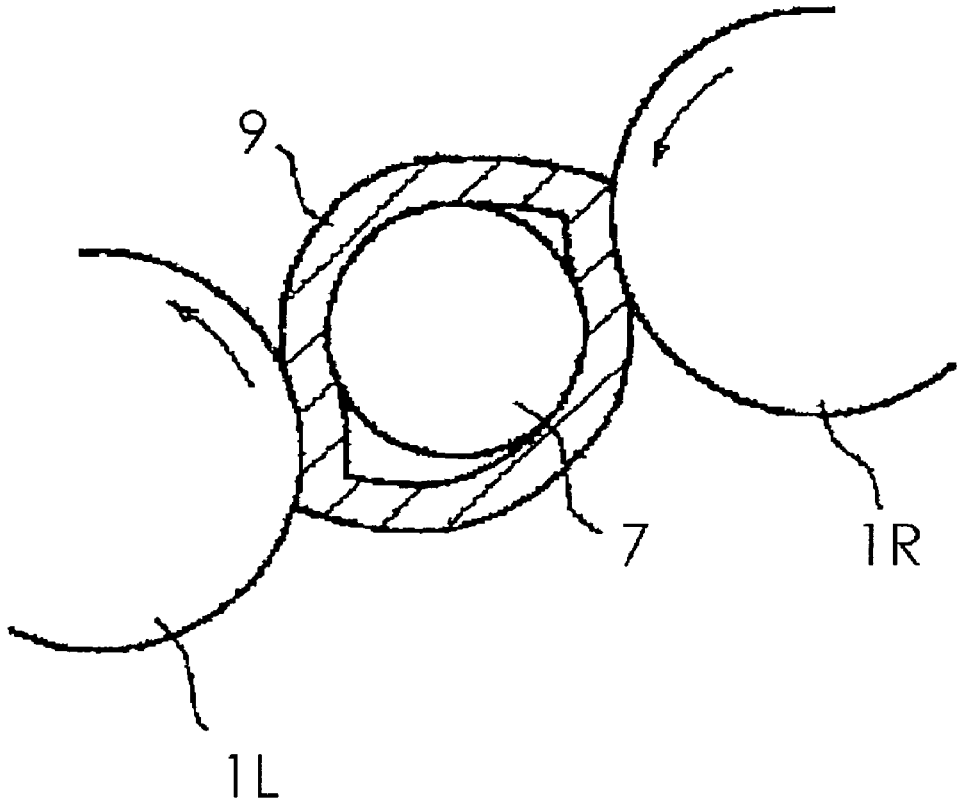
[FIG. 5] This shows, in exaggeration, the material deformation during piercing from the gorge between main rolls to the roll outlet side in piercing and rolling.
Figure 6:
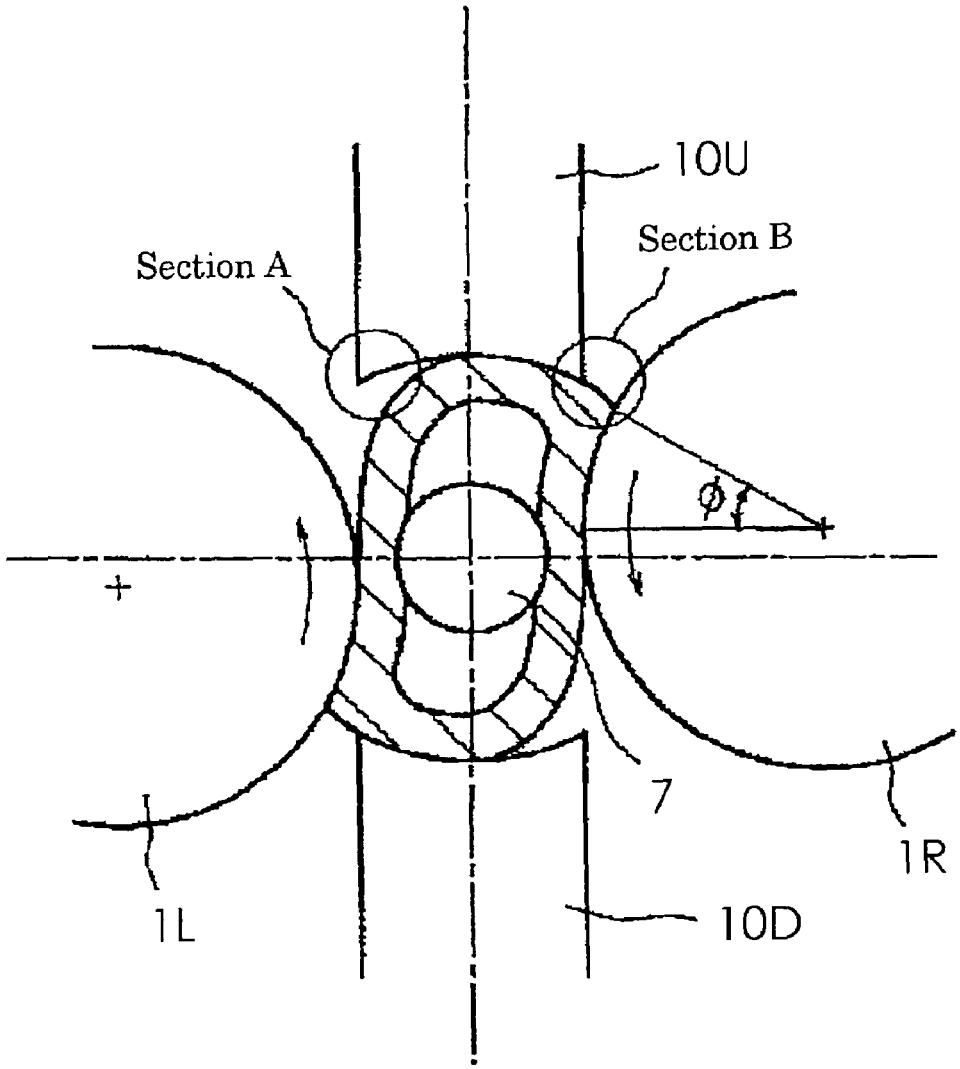
[FIG. 6] This is a schematic illustration of the suppression of the expansion of the material diameter by disk rolls.
Figure 7:
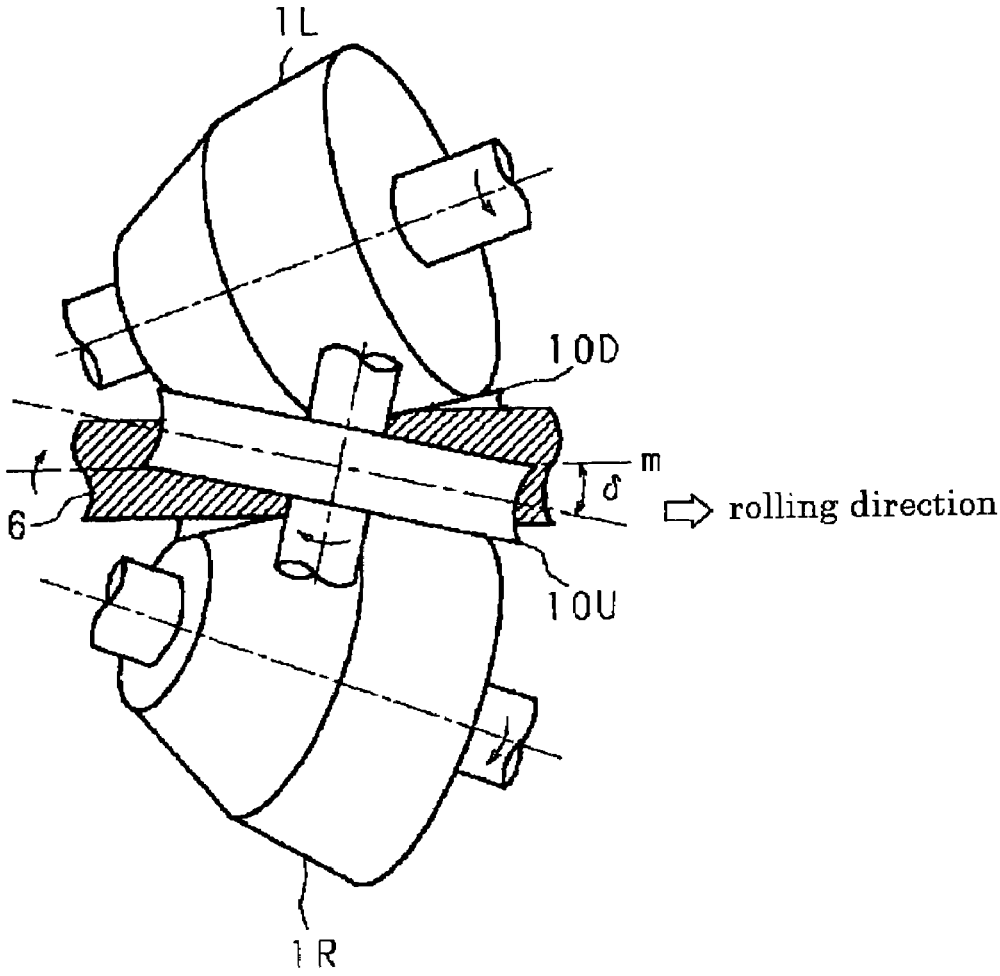
[FIG. 7] This shows an exemplary arrangement of main rolls and disk rolls in a piercing-rolling mill.
Figure 8:
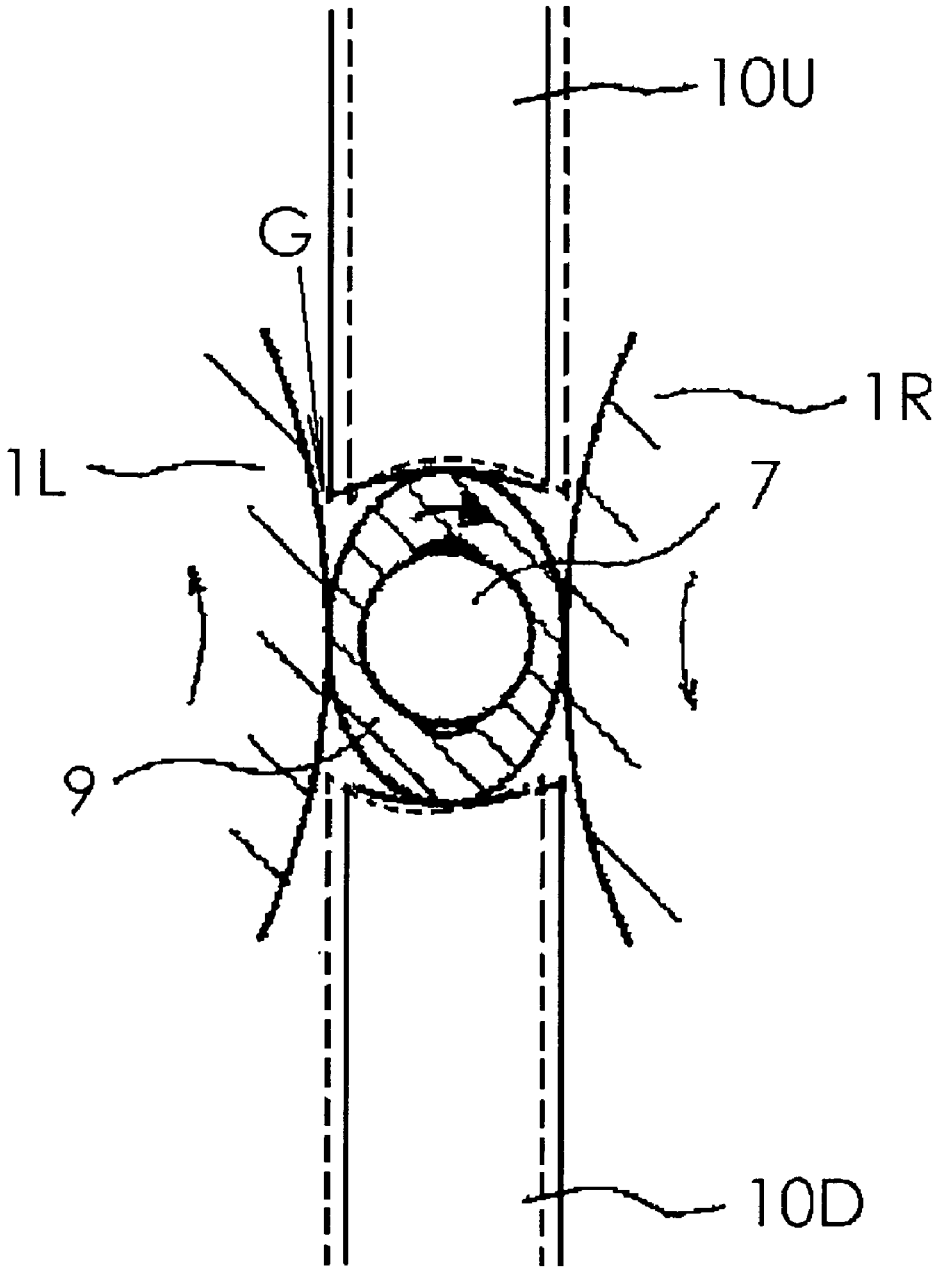
[FIG. 8] This is a schematic illustration of the widening of the gap G between a main roll 1L and a disk roll 10U.
Figure 9:
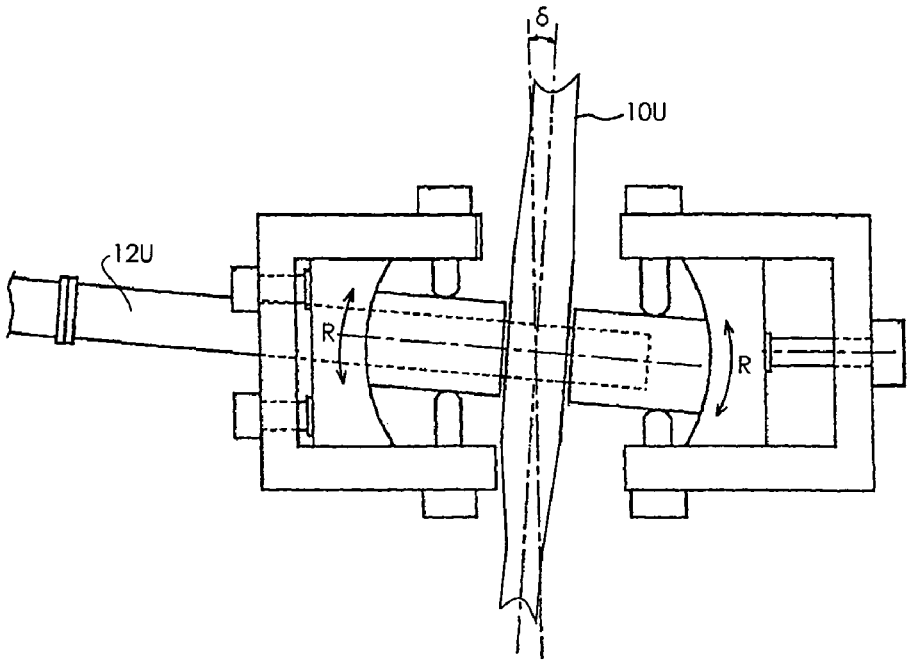
[FIG. 9] This shows a rotation mechanism R for rendering the disk roll skew angle δ variable.
Figure 10:
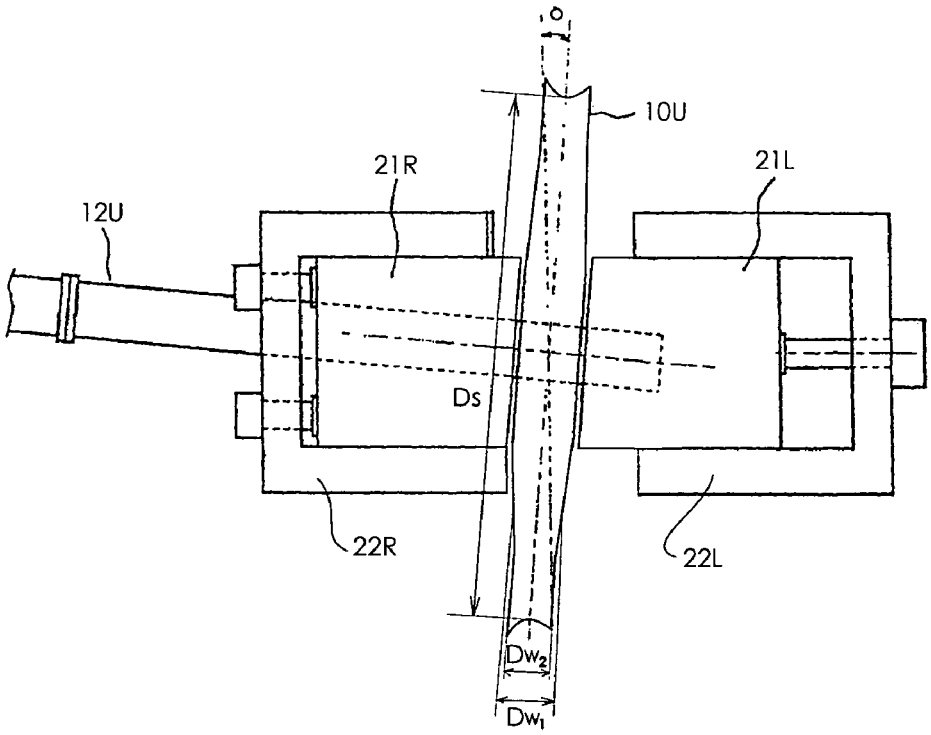
[FIG. 10] This shows an example in which the disk roll skew angle δ is fixed in accordance with the invention.
Figure 11:
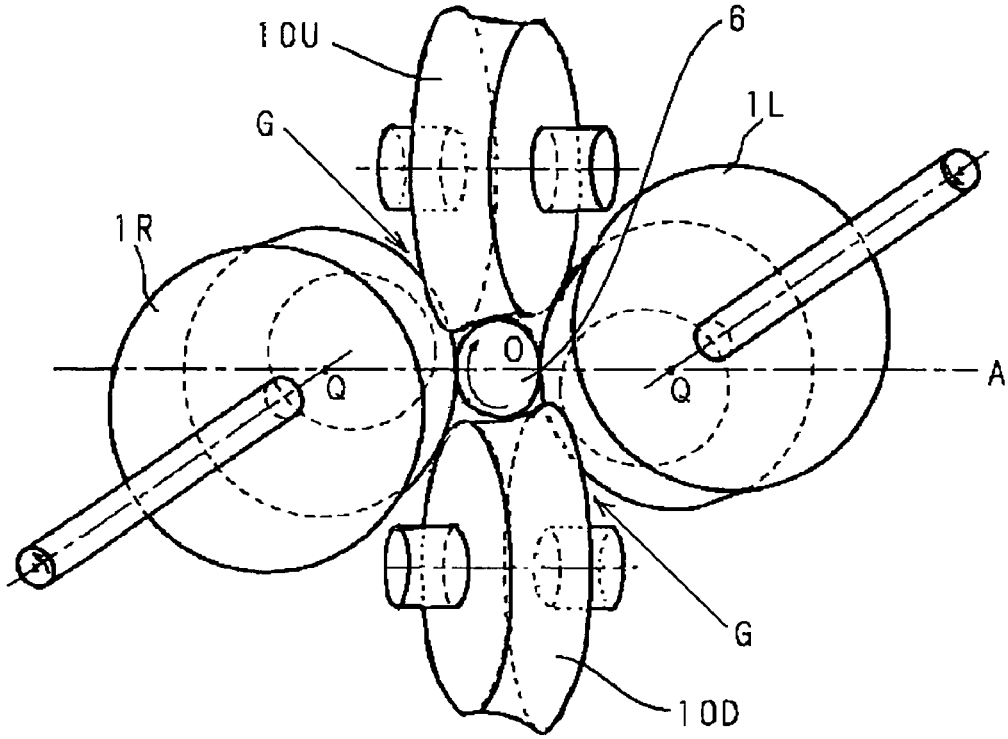
[FIG. 11] This shows an example of the piercing-rolling mill according to the invention.

1R, 1L—Main rolls
6—Billet
7—Plug
9—Hollow shell
10, 10U, 10D—Disk rolls
12U—Universal joint
21R, 21L—Roll chocks
22R, 22L—Chock supports
α—Main roll outlet side surface angle
β—Main roll feed angle
γ—Main roll toe angle
δ—Disk roll skew angle
κ—Disk roll feed angle
Ø—Taking up angle
A—Plane including point Q and pass center m
Ds—Groove bottom-to-groove bottom distance corresponding to minimum disk diameter in each disk roll
$Dw_1$—Average disk roll thickness
$Dw_2$—Curved part width on peripheral surface of each disk roll
G—Outlet side gap between main roll and disk roll
H—Hollow shell
m—Pass center
Q—Main roll gorge center before setting of main roll feed angle β
R—Rotation mechanism
d—Billet outside diameter

The invention claimed is:

1. A piercing and rolling method for seamless tubes using a piercing and rolling apparatus which is provided with a pair of cone-shaped main rolls and a pair of disk rolls, each pair being arranged in an opposing manner with a pass line therebetween as a center axis, and a plug whose center axis coincides with the pass line, wherein a billet to be pierced and rolled is advanced while being spirally rotated by a drive rotation of the main rolls; the method of which is characterized in each of the disk rolls being arranged in an inclined state at a fixed skew angle δ to the pass line, characterized in that an average thickness $Dw_1$ of the disk roll and an outside diameter d of the billet to be pierced and rolled satisfy the following inequality (1):

$$Dw_1/d>0.8 \qquad \text{inequality (1)}$$

wherein $Dw_1$ and d are, respectively, the average thickness of the disk roll and an outside diameter of the billet to be pierced and rolled, while the average thickness of the disk roll is the average thickness of a disk-shaped body excluding a peripheral curved groove part of the disk roll.

2. The piercing and rolling method for seamless tubes according to claim 1, characterized in that a distance Ds between peripheral groove bottoms corresponding to a smallest diameter of disk roll, a width $Dw_2$ of a curved surface part on a peripheral surface of the disk roll, and an outside diameter d of the billet to be pierced and rolled, are selected so as to satisfy the following inequalities (2) and (3):

$$9 \leqq Ds/d \leqq 16 \qquad \text{inequality (2)}$$

$$Dw_2/d>0.8 \qquad \text{inequality (3)}$$

wherein Ds is a distance between the peripheral groove bottoms corresponding to the smallest diameter of the disk roll, $Dw_2$ is a width of the curved surface part on the peripheral surface of disk roll, and d is an outside diameter of the billet to be pierced and rolled.

3. A piercing and rolling method for seamless tubes using a piercing and rolling apparatus which is provided with a pair of cone-shaped main rolls and a pair of disk rolls, each pair being arranged in an opposing manner with a pass line therebetween as a center axis, and a plug whose center axis coincides with a pass line therebetween as a center axis, and a plug whose center axis coincides with the pass line, wherein a billet to be pierced and rolled is advanced while being spirally rotated by a drive rotation of the main rolls; the method of which is characterized in each of the disk rolls being arranged in an inclined state at a fixed skew angle δ to the pass line, characterized in that a distance Ds between peripheral groove bottoms corresponding to a smallest diameter of disk roll, a width $Dw_2$ of a curved surface part on a peripheral surface of the disk roll, and an outside diameter d of the billet to be pierced and rolled, are selected so as to satisfy the following inequalities (2) and (3):

$$9 \leqq Ds/d \leqq 16 \qquad \text{inequality (2)}$$

$$Dw_2/d>0.8 \qquad \text{inequality (3)}$$

wherein Ds is a distance between the peripheral groove bottoms corresponding to the smallest diameter of the disk roll, $Dw_2$ is a width of the curved surface part on the peripheral surface of disk roll, and d is an outside diameter of the billet to be pierced and rolled.

4. A piercing and rolling apparatus for seamless tubes which is provided with a pair of cone-shaped main rolls and a pair of disk rolls, each pair being arranged in an opposing manner with a pass line therebetween as a center axis, and a plug whose center axis coincides with the pass line, wherein a billet to be pierced and rolled is advanced while being spirally rotated by a drive rotation of the main rolls; the apparatus of which is characterized in each of the disk rolls being arranged in an inclined state at a fixed skew angle δ to the pass line, characterized in that an average thickness $Dw_1$ of the disk roll and an outside diameter d of the billet to be pierced and rolled satisfy the following inequality (1):

$$Dw_1/d>0.8 \qquad \text{inequality (1)}$$

wherein $Dw_1$ and d are, respectively, an average thickness of the disk roll and an outside diameter of the billet to be pierced and rolled, while the average thickness of the disk roll is the average thickness of a disk-shaped body excluding a peripheral curved groove part of the disk roll.

5. The piercing and rolling apparatus for seamless tubes according to claim 4, characterized in that a distance Ds between peripheral groove bottoms corresponding to a smallest diameter of the disk roll, a width $Dw_2$ of a curved surface part on a peripheral surface of the disk roll, and an outside diameter d of the billet to be pierced and rolled, are selected so as to satisfy the following inequalities (2) and (3):

$$9 \leqq Ds/d \leqq 16 \quad \text{inequality (2)}$$

$$Dw_2/d > 0.8 \quad \text{inequality (3)}$$

wherein Ds is a distance between the peripheral groove bottoms corresponding to the smallest diameter of disk roll, $Dw_2$ is a width of the curved surface part on the peripheral surface of the disk roll, and d is an outside diameter of the billet to be pierced and rolled.

6. A piercing and rolling apparatus for seamless tubes which is provided with a pair of cone-shaped main rolls and a pair of disk rolls, each pair being arranged in an opposing manner with a pass line therebetween as a center axis, and a plug whose center axis coincides with the pass line, wherein a billet to be pierced and rolled is advanced while being spirally rotated by a drive rotation of the main rolls; the apparatus of which is characterized in each of the disk rolls being arranged in an inclined state at a fixed skew angle δ to the pass line, characterized in that a distance Ds between peripheral groove bottoms corresponding to a smallest diameter of the disk roll, a width $Dw_2$ of the curved surface part on a peripheral surface of the disk roll, and an outside diameter d of the billet to be pierced and rolled, are selected so as to satisfy the following inequalities (2) and (3):

$$9 \leqq Ds/d23\ 16 \quad \text{inequality (2)}$$

$$Dw_2/d > 0.8 \quad \text{inequality (3)}$$

wherein Ds is a distance between the peripheral groove bottoms corresponding to the smallest diameter of disk roll, $Dw_2$ is a width of the curved surface part on the peripheral surface of the disk roll, and d is an outside diameter of the billet to be pierced and rolled.

* * * * *